United States Patent [19]

Laszlo

[11] 4,146,041

[45] Mar. 27, 1979

[54] BROWN CIGARETTE WRAPPERS

[75] Inventor: Tibor S. Laszlo, Henrico, Va.

[73] Assignee: Philip Morris Incorporated, New York, N.Y.

[21] Appl. No.: 791,896

[22] Filed: Apr. 28, 1977

[51] Int. Cl.[2] ..... A24D 15/03

[52] U.S. Cl. ..... 131/15 R; 131/2; 131/140 C; 162/139; 162/162; 8/7

[58] Field of Search ..... 8/7, 53; 162/162, 139; 131/17, 2, 15, 140

[56] References Cited

PUBLICATIONS

Abstract Bulletin, Institute of Paper Chemistry, 31:1027.

CA 47:7778e.

Recent Progress in the Chemistry of Natural and Synthetic Colouring Matters, T. S. Gore et al., Ed. Academic Press, N. Y. (1962), pp. 107–108.

CA 24:3020.

*Primary Examiner*—Robert W. Michell

*Assistant Examiner*—V. Millin

*Attorney, Agent, or Firm*—Arthur I. Palmer, Jr.; George E. Inskeep; Susan A. Hutcheson

[57] ABSTRACT

The present invention relates to brown cigarette paper having reduced gas phase constituents during pyrolysis wherein the paper which has been stained with humic acid or salts thereof is further treated by washing with water in an amount effective to reduce the amount of water-soluble alkali metal salts present in the paper.

6 Claims, 4 Drawing Figures

6X

ASH FROM CIGARETTE PAPER HAVING 0.1% SODIUM ION

ASH FROM CIGARETTE PAPER HAVING 1.2% SODIUM ION

ASH FROM CIGARETTE PAPER HAVING 0.8% SODIUM ION

ASH FROM CIGARETTE PAPER HAVING 0.1% SODIUM ION

ASH FROM CONTROL CIGARETTE

BROWN CIGARETTE WRAPPERS

BACKGROUND OF THE INVENTION

The use of humic acid and fractions thereof as dyes is well known. ("Recent Progress in the Chemistry of Natural and Synthetic Coloring Matters," T. S. Gore et al. eds., Academic Press, N.Y. 1962, pps. 99–112.) Recently, a variety of cigarettes manufactured with brown paper wrappers have enjoyed increased popularity among smokers, and some of these cigarettes are fabricated using brown wrappers stained with humic acid. Processes for staining cigarette paper brown have included the use of dyes such as synthetic azo dyes, dyes produced from walnut shells, caramel, tannic acid and the like. However, the aforementioned stains or dyes are undesirable for a variety of reasons. First, the azo dyes may produce undesirable pyrolysis products; secondly, the amount of caramel required to produce the desired intensity of brown color considerably inhibits the burn rate of the paper. The use of such stains as tannic acid may provide the desired brown color; however, treatment of this type simultaneously reduces the porosity of the paper thereby also reducing the rate of combustion and adversely affects the gas phase composition (see Austrian Pat. No. 175,148).

Analytical studies using the humic acid treated brown wrappers have indicated in some instances a tendency toward increased gas phase constituents. Various attempts have been made to reduce constituents such as carbon monoxide, by using more efficient filter elements, by increasing the degree of ventilation in filters or by increasing the porosity of the paper or wrapper, etc.; however, none of these methods have proven to be entirely satisfactory.

THE INVENTION

This invention concerns the improvement of humic acid treated paper or sheet material in which tobacco or any other smoking product is rolled for the fabrication of cigarettes, cigars, or the like.

The invention relates specifically to a process for treating humic acid dyed brown paper suitable for use as wrappers for smoking products wherein some of the products of pyrolysis are substantially reduced. In an effort to identify the causes for increased gas phase delivery of humic acid coated papers, cigarettes were fabricated using an experimental brown paper. The cigarettes were partially smoked and then extinguished. Microscopic examination of the ash at the char line of the partially smoked cigarettes indicated beading at the char line and a reduced surface porosity ash formation which may be reducing the amount of air penetrating into the bed of tobacco at the char line. Under these conditions, an increased amount of carbon monoxide was measured in the gas phase of the cigarette smoke. It has been postulated by the inventor that water soluble alkali metal salts, such as, for example, sodium salts, fuse within and on the surface of the ash and at the char line and are thus preventing the infiltration of oxygen into the cigarette at the char line. Therefore, some means was needed to remove or substantially reduce the content of salts, and particularly sodium salts from the humic acid-coated paper in order to subsequently reduce carbon monoxide formation in the burning cigarette.

Thus it is an object of this invention to provide a method for producing a humic-acid coated paper or wrapper having a reduced content of sodium ions, whereby smoking products produced from said paper can be materially improved.

It is a further object of this invention to provide methods and means which individually operate to provide a more desirable brown paper or wrapper from the standpoint of gas phase delivery, whereby such gas phase constituents such as carbon monoxide are substantially reduced.

Other objects and advantages will be discussed and described in detail hereinbelow.

DESCRIPTION OF THE PREFERRED EMBODIMENTS

Figure 1:
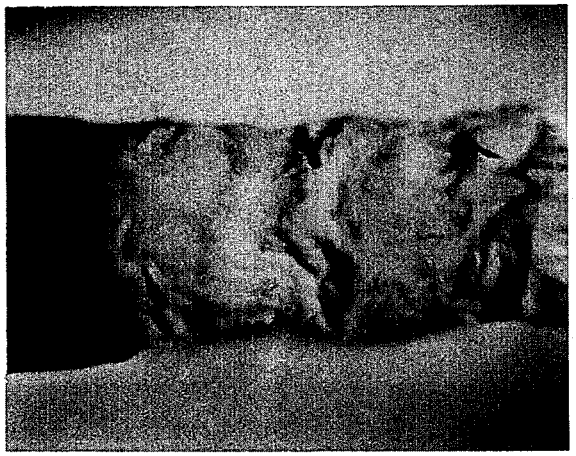
FIGS. 1, 2, and 3 illustrate the ash formation of partially smoked cigarettes fabricated using humic acid coated paper having a sodium ion content of 1.2%, 0.8%, and 0.1% respectively.

By definition, humic acids are allomelanins found in soil, peat, and low-rank coal. They are generally alkali soluble and precipitated in the presence of acids. From a chemical standpoint, humic acids generally consist of a mixture of complex macromolecules characterized as having polymeric phenolic structures with the ability of chelate with metals. In addition, humic acids have a strong base-binding power and this ion-exchange capability can be used advantageously in their use as dyes. There are many variations of humic acid depending upon differences in the plant remains from which they originate as well as the soil, the climate, microflora, drainage, etc.

Humic acids, by nature, are intensely chocolate brown in color and because of their natural origin, they are particularly preferred over synthetic dyes as staining pigments for producing brown wrappers or papers for smoking products. Generally, a alkaline solution is prepared by mixing the powdery humic acid with an alkali metal hydroxide such as potassium hydroxide, sodium hydroxide, or the like, with sodium hydroxide being preferred, to form a soluble humate salt. This solution is used to impregnate the paper on one or both sides, and this is followed by a fixing step with a salt of an alkaline earth metal. In essence, sodium ions are exchanged for alkaline earth metal ions in the "fixing" process, thus leaving a water insoluble humate salt on the paper. However, some of the displaced sodium ions remain on the humate-impregnated paper. It was postulated that the presence of the remaining sodium salt could be affecting combustion and was having a direct influence on the amount of carbon monoxide evolved when the paper was burned.

By way of modification, it has been found that improvement in the smoking characteristics and a decrease in the delivery of carbon monoxide may be realized by a continuous water washing process of the humate impregnated paper.

In the practice of modifying the paper, the preferred method involves the use of a size press wherein the paper is fed through a water bath at room temperature and at a rate sufficiently slow to allow almost complete dissolution and removal of sodium ions. Of course, it will be understood, that essentially all other water soluble salts will also be removed using this process. A free-flowing water supply is preferred to insure the most efficient removal of the water soluble salts. Following the wash step, the paper is dried and used for fabricating smoking products.

In an alternate approach, sodium humate is added to a slurry of purified cellulose pulp and the slurry is used as a furnish in a conventional papermaking machine to produce a brown paper suitable for use in the fabrication of smoking products. In this particular instance, the sodium humate is "fixed" on the paper by subsequent treatment with a salt of an alkaline earth metal and following fixing, the paper is washed continuously to achieve a significant reduction of water-soluble salts.

In the processes discussed hereinabove, it is desirable to reduce the sodium content of the paper to a concentration within the range of less than 0.3% and preferably to about 0.1% sodium by weight of the dried paper. It will be understood that the time required to effect a reduction to about 0.1 to 0.3% sodium will depend to a large extent on the original concentration of sodium in the paper, the rate of passage of the paper through the water bath and the rate of flow of the wash water. In some instances, where the sodium concentration is particularly high, i.e., greater than 1%, it may be necessary to repeat the wash step several times to achieve the desired reduction of water-soluble salts.

The following examples are illustrative, but it is to be understood that the invention is not limited thereto.

EXAMPLE 1

A roll of humic acid dyed cigarette paper produced for experimental purposes and having an original sodium content of 1.2% as determined by atomic absorption was placed on a conventional size press and passed through a running water bath. The excess water was removed and the treated paper was then passed over a series of heated drying rolls to evaporate the residual water. A series of runs were made using the same experimental paper in which the residence time in the wash water was increased so as to achieve a variety of reduced sodium concentrations.

Following drying, the washed papers were used to fabricate cigarettes using a commercial tobacco blend. The sodium content of the washed papers was determined by atomic absorption and found to be 0.8% (coded cigarette A) and 0.1% (coded cigarette B) respectively, by weight of the dried paper. In a similar fashion, control cigarettes were fabricated using the unwashed experimental paper which had a sodium content of 2.1%. All of the above cigarettes had conventional cellulose acetate filters attached thereto. Similar cigarettes (coded cigarette C) were fabricated using humic acid treated paper which was washed to reduce the sodium salt concentration to 0.8% and was then further treated with dilute sodium hydroxide to produce a final concentration of 1.0% sodium by weight of the dry paper.

The cigarettes thus fabricated were smoked in duplicate under controlled laboratory conditions and the gas phase which passed through the filters was trapped and analyzed for carbon monoxide using known infrared spectroscopy techniques.

The results are tabulated below in Table 1.

Table 1

| | Control | Cigarette A | Cigarette B | Cigarette C |
|---|---|---|---|---|
| % Sodium | 1.2 | 0.8 | 0.1 | 1.0 |
| CO mg/cigt. | 28.9 | 25.4 | 18.8 | 33.8 |
| P.C. | 15.0 | 13.2 | 13.4 | 14.2 |
| CO* mg/p | 1.927 | 1.924 | 1.403 | 2.380 |
| Tar | 1.167 | 1.339 | 1.126 | 1.59 |
| Nicotine | 18.75 | 20.50 | 17.01 | 24.15 |
| G.P.* Sec/50cc | 80 | 44 | 32 | 41 |

*P.C. = puff count; P. = puff; G.P. = Greiner porosity.

Test results of the above-cited examples show that there is an appreciable reduction in the carbon monoxide delivery as the concentration of sodium in the paper is diminished. Conversely, when sodium ions are added back to the washed humic acid coated paper (Cigarette C), there is a substantial increase in carbon monoxide delivery.

Samples of the above cigarettes were submitted for microscopical examination in order to determine the appearance of the cigarette ash as a function of the sodium salt concentration.

Figure 2:
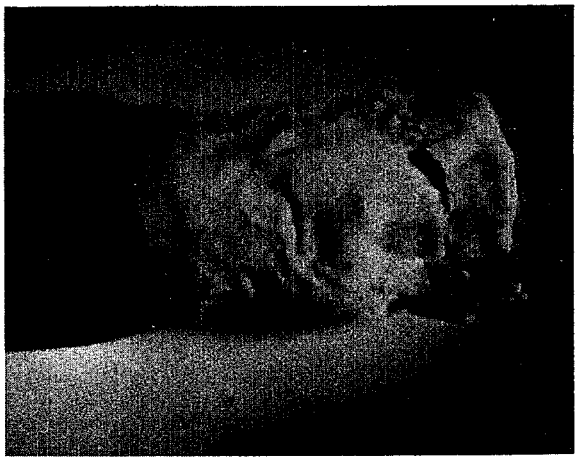
Figure 3:
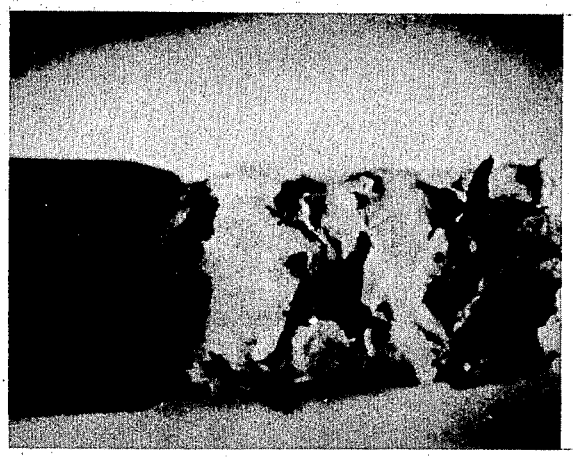
Figure 4:
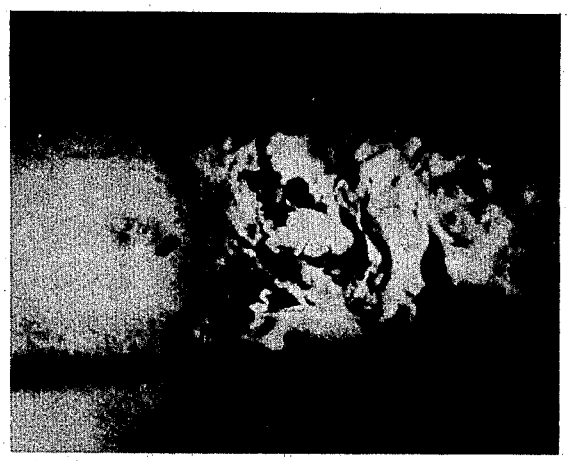
FIG. 4 illustrates the ash of a partially smoked cigarette fabricated from conventional white cigarette paper and containing no humic acid or salts thereof.

Examination of the ash formation of the partially smoked cigarettes using light optics showed that the cigarette having the highest concentration of sodium appeared to have an ash with less holes. Referring now to the photographs, FIG. 1 illustrates the compactness and almost solid nature of the ash from a cigarette fabricated from humic acid coated paper having a sodium concentration of 1.2%. Likewise, FIG. 2 illustrates the ash from a cigarette having humic acid coated paper with a sodium concentration of 0.8%. The ash is only slightly improved and still has a relatively solid, compact appearance. FIG. 3 represents the photograph of the ash of a cigarette having a sodium concentration of 0.1% sodium on the humic acid coated paper. It is evident from this photograph that there is a significant improvement in the ash formation. The ash appears to be more porous and is less compact in nature. FIG. 4 is a photograph of a control cigarette fabricated from conventional untreated white cigarette paper having a sodium concentration of 0.1%. The ash is quite porous and is similar in appearance to the ash shown in FIG. 3. From the above studies it would appear that the lack of holes and the compactness of the ash is a function of the amount of sodium salts that were present in the cigarette paper.

EXAMPLE 2

In a manner similar to Example 1, a commercially available humic acid coated paper (produced by Papeteries de Malaucene, Paris, France, coded PEC2) was washed continuously on a size press until the sodium content was reduced to 0.1% as determined by atomic absorption.

Experimental cigarettes were fabricated from the washed paper and control cigarettes were made using the unwashed paper which had a sodium content of 0.5%. All of the cigarettes had conventional cellulose acetate filters.

The cigarettes were smoked under controlled laboratory conditions and the gas phase was trapped and analyzed for carbon monoxide content. The results are tabulated in Table 2.

Table 2

| | Control | Experimental | % Reduction |
|---|---|---|---|
| % Sodium | 0.5 | 0.1 | 80 |
| CO mg/cigt. | 23.3 | 19.5 | 16 |
| P.C.* | 15.0 | 13.5 | 10 |

Table 2-continued

| | Control | Experimental | % Reduction |
|---|---|---|---|
| CO/P* | 1.553 | 1.444 | 7 |

*P.C. = puff count; P. = puff.

While the reductions obtained in this experiment are not as dramatic as those tabulated in Example 1, this Malaucene paper only contains about half the sodium of the previous experimental paper. In addition, the porosity has not dropped as much on this trial, and information on the specific salts used as post-treatments for fixing are unknown.

It will be apparent from the foregoing that we have provided a cigarette paper and method and means for producing same wherein the smoking characteristics with respect to gas phase delivery are substantially improved. Such papers or wrappers produced in accordance with the practice of this invention find beneficial use with current smoking products. Although the examples are directed to humic acid coated papers, it is apparent that the presence of excess sodium salts, whether on humic acid coated paper or on conventional white cigarette paper, may influence the amount of carbon monoxide generated on pyrolysis. Therefore, the practice of this invention encompasses the removal of excess alkali metal salts from both humic acid treated papers as well as white cigarette paper.

It will be understood that changes may be made in the operation details without departing from the spirit of the invention, especially as defined in the following claims.

What is claimed is:

1. The method of preparing brown paper for use as wrappers for smoking products which comprises
   (a) staining the paper with a soluble humate salt,
   (b) fixing the humate on the paper by ion exchange to render it insoluble, and
   (c) washing the fixed paper to remove soluble salts formed during the ion exchange step.

2. The method of claim 1 wherein the paper is stained with an alkali metal humate.

3. The method of claim 1 wherein the soluble humate salt is rendered insoluble on the paper by ion exchange with an alkaline earth metal.

4. The method of claim 3 wherein the washing step is effective to remove substantially all of the alkali metal salt formed during the ion exchange step.

5. The method of claim 4 wherein the salt removed is a sodium salt.

6. A smoking product having a wrapper fabricated from paper which has been stained with an alkali metal salt of humic acid, followed by ion exchange with an alkaline earth metal to render the humate insoluble, and being further treated by washing the paper with water in an amount sufficient to remove substantially all of the alkali metal salt formed during the ion exchange step, said wrapper containing an insoluble humate and being substantially free of alkali metal salts.

* * * * *